US009347417B2

(12) United States Patent
Shomura et al.

(10) Patent No.: US 9,347,417 B2
(45) Date of Patent: May 24, 2016

(54) ENGINE START CONTROL SYSTEM

(71) Applicant: SUZUKI MOTOR CORPORATION, Hamamatsu-shi, Shizuoka (JP)

(72) Inventors: Nobuyuki Shomura, Hamamatsu (JP); Tatsunori Kataoka, Hamamatsu (JP); Akinori Yamazaki, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 384 days.

(21) Appl. No.: 13/846,022

(22) Filed: Mar. 18, 2013

(65) Prior Publication Data

US 2013/0247878 A1 Sep. 26, 2013

(30) Foreign Application Priority Data

Mar. 26, 2012 (JP) ..... 2012-070001

(51) Int. Cl.
*F02N 3/00* (2006.01)
*F02N 19/00* (2010.01)
(Continued)

(52) U.S. Cl.
CPC *F02N 19/00* (2013.01); *F02N 3/00* (2013.01); *F02N 11/0848* (2013.01); *F02D 2200/704* (2013.01); *F02N 11/04* (2013.01); *F02N 2200/02* (2013.01)

(58) Field of Classification Search
CPC ..... F02D 41/062; F02D 41/06; Y02T 10/123; F02N 19/005; F02N 11/08; F02N 11/0814; F02N 1/00; F02N 1/005; F02N 1/02; F02N 3/00; F02N 3/02; F02N 3/04
USPC ..... 123/179.1–179.9, 472
See application file for complete search history.

(56) References Cited

U.S. PATENT DOCUMENTS 4,951,647 A 8/1990 Ezumi et al.
6,445,996 B1 * 9/2002 Corbeels ..... F02D 41/0002 701/104
2003/0230287 A1 * 12/2003 Ozeki ..... F02D 41/222 123/479

(Continued)

FOREIGN PATENT DOCUMENTS

DE 3914654 11/1989
EP 1 433 944 6/2004

(Continued)

OTHER PUBLICATIONS

European Search Report dated Nov. 11, 2014, which issued during prosecution of European Application No. 13158631.5, which corresponds to the present application.

*Primary Examiner* — Sizo Vilakazi
(74) *Attorney, Agent, or Firm* — Troutman Sanders LLP

(57) ABSTRACT

In the process of starting by a recoil starter, a maximum value detection section of an ECM detects a maximum value of pressure (basic atmospheric pressure) in an intake pipe detected by a pressure sensor, within a predetermined range of crank angle after activation of the ECM. An idling control unit gives feedback control on an ISC valve based on engine speed detected by an engine speed sensor, to thereby keep idling engine speed at a specified value. A correction unit corrects a basic atmospheric pressure detected by the maximum value detection section based on the duty ratio of the ISC valve in idling, and uses the result as the atmospheric pressure. A storage unit 9*d* stores a map in which the duty ratio of the ISC valve in idling is correlated with the amount of correction to be made on the basic atmospheric pressure.

2 Claims, 5 Drawing Sheets

(51) Int. Cl.
*F02N 11/08* (2006.01)
*F02N 11/04* (2006.01)

(56) References Cited

U.S. PATENT DOCUMENTS

2009/0020092 A1* 1/2009 Kishibata ..... F02D 41/062 123/179.3
2009/0198436 A1 8/2009 Sasaki
2010/0018189 A1* 1/2010 Oi ..... F01N 3/22 60/290
2011/0073077 A1* 3/2011 Yamaguchi ..... F02D 41/0042 123/491
2011/0276254 A1 11/2011 Tsukamoto et al.
2012/0291754 A1* 11/2012 Yamaguchi ..... F02D 41/2464 123/458
2013/0247857 A1* 9/2013 Yamazaki ..... F02N 11/0848 123/179.3

FOREIGN PATENT DOCUMENTS

EP 2 362 087 8/2011
JP 11247706 A 9/1999

* cited by examiner

| | X1 | X2 | X3 | X4 | X5 | X6 | X7 | X8 |
|---|---|---|---|---|---|---|---|---|
| AMOUNT OF CORRECTION | a | b | c | d | e | f | g | h |

ENGINE START CONTROL SYSTEM

CROSS-REFERENCE TO RELATED APPLICATIONS

This application is based upon and claims the benefit of priority of the prior Japanese Patent Application No. 2012-070001, filed on Mar. 26, 2012, the entire contents of which are incorporated herein by reference.

BACKGROUND OF THE INVENTION

1. Field of the Invention

The present invention relates to an engine start control system which is convenient when used for manually starting an engine with the aid of a recoil starter or the like.

2. Description of the Related Art

Some types of engines used for outboard motor employ an ECM (Engine Control Module) for controlling fuel injection by an injector. The ECM in this case is configured to use the atmospheric pressure as one parameter for regulating the fuel injection.

Patent Document 1 discloses a configuration aimed at detecting the atmospheric pressure without using the atmospheric pressure sensor, wherein the atmospheric pressure is detected by a pressure sensor for detecting air pressure in an intake pipe, based on a pressure detection signal of the pressure sensor detected when the control unit (ECM) is powered ON, while a crankshaft stays still.

In particular, marine vessels hardly encounter a situation such that the atmospheric pressure sharply changes (for example, travel towards highlands) in a single operation, so that information of the atmospheric pressure only at the start of operation will suffice. Accordingly, there will be no need of equipping a dedicated atmospheric pressure sensor, if the atmospheric pressure may be known from the pressure in the intake pipe as described in Patent Document 1, and this will give a large cost merit.

[Patent Document 1] Japanese Laid-Open Patent Publication No. H11-247706

SUMMARY OF THE INVENTION

The configuration described in Patent Document 1 is, however, premised on installing a battery. In a configuration without the battery, the ECM will be activated as powered from a generator which operates in association with rotation of a crankshaft of the engine. In other words, the ECM will not be activated unless the crankshaft rotates, so that it is unable to detect the atmospheric pressure based on the pressure detection signal of the pressure sensor, when the crankshaft stays still, as described in Patent Document 1.

For the configuration without the battery, there is now one possible idea of determining the atmospheric pressure, by detecting the maximum value of pressure in the intake pipe, when the ECM is powered from the manually-cranked generator in the process of starting using the recoil starter. In the manually cranking, that is, in a period before the engine starts to rotate under its own power, the pressure in the intake pipe becomes negative relative to the atmospheric pressure in the intake process, and peaks at the time of switching from the exhaust process to the intake process, showing the maximum value close to the atmospheric pressure.

By the way, while having described that the maximum value of pressure in the intake pipe during manually cranking is close to the atmospheric pressure, a shift from the atmospheric pressure actually occurs depending on the state of opening of the intake pipe involved therein. The larger the state of opening of the intake pipe during manually cranking, the larger the volume of air fed thereto, and the closer the maximum value of pressure in the intake pipe to the atmospheric pressure. Conversely, the closer the state of opening to the closed state, the smaller the volume of air fed thereto, and the more lower the maximum value of pressure in the intake pipe than the atmospheric pressure.

Difference in the state of opening of the intake pipe during the manually cranking is typically ascribable to the following factors. The manually cranking is generally carried out while keeping the throttle almost closed, where there is some variation from engine to engine, in the leakage from fully-closed throttle valve. Even the same engine may vary in the leakage from fully-closed throttle valve with time. In some configuration, the intake pipe has a bypass port connected to the downstream side of the throttle valve. The bypass port has an adjust screw attached thereto, adjustment of which changes the aperture of the bypass port, and allows regulation of volume of air fed to the intake pipe.

With the issues described in the above, the present invention was conceived and an object of which is to obtain the atmospheric pressure in a more exact manner, when the pressure detected in the intake pipe during the manually cranking is assumed as the atmospheric pressure.

According to the present invention, there is provided an engine start control system which includes a manual starter which allows manual rotation of a crankshaft of an engine; a generator which operates in association with rotation of the crankshaft; an electronic fuel injector which feeds a fuel to the engine; an engine control device which operates using electric power generated by the generator, and controls the electronic fuel injector; a pressure detection section which detects pressure in an intake pipe on the downstream side of a throttle valve of the engine; and an air regulator which feeds air to the intake pipe on the downstream side of the throttle valve. The engine control device includes a maximum value detection section which detects, in the process of starting by the manual starter, a maximum value of pressure in the intake pipe detected by the pressure detection section, within a predetermined range of crank angle after activation of the engine control device; an idling control section which controls the air regulator to thereby keep the idling engine speed at a specified value; and a correction section which corrects the maximum value of pressure in the intake pipe detected by the maximum value detection section to the atmospheric pressure, based on a control volume of the air regulator made by the idling control section.

According to another aspect of the present invention, there is provided the engine start control system, wherein the control volume of the air regulator by the idling control section is preliminarily correlated with the amount of correction made on the maximum value of pressure in the intake pipe, and the correction section performs the correction using the amount of correction.

According to another aspect of the present invention, there is provided the engine start control system, which further includes a throttle aperture detection section which detects aperture of the throttle valve. The correction section does not perform the correction, if the aperture of the throttle valve detected by the throttle aperture detection section is not smaller than the specified value, within a predetermined range of crank angle after activation of the engine control device.

DETAILED DESCRIPTION OF THE PREFERRED EMBODIMENTS

Preferred embodiments of the present invention will be explained, referring to the attached drawings.

Figure 1:
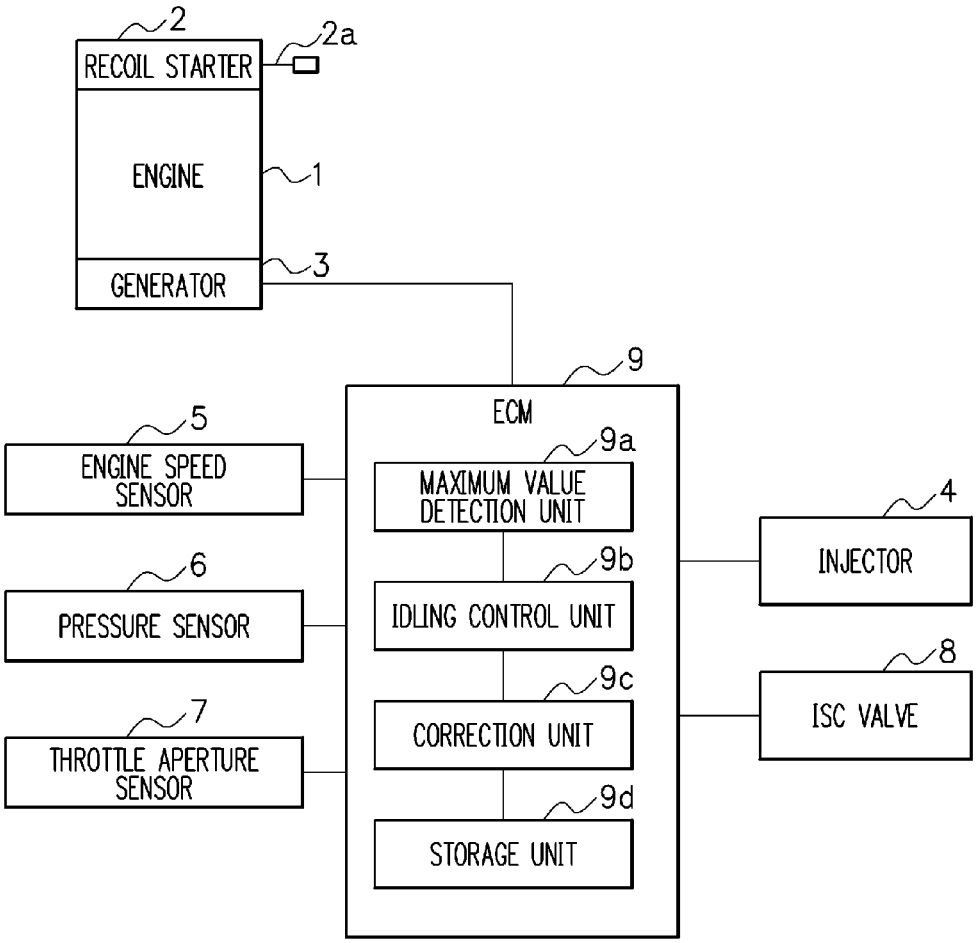
FIG. 1 is a drawing illustrating a schematic configuration of an engine start control system of one embodiment.
Figure 2:
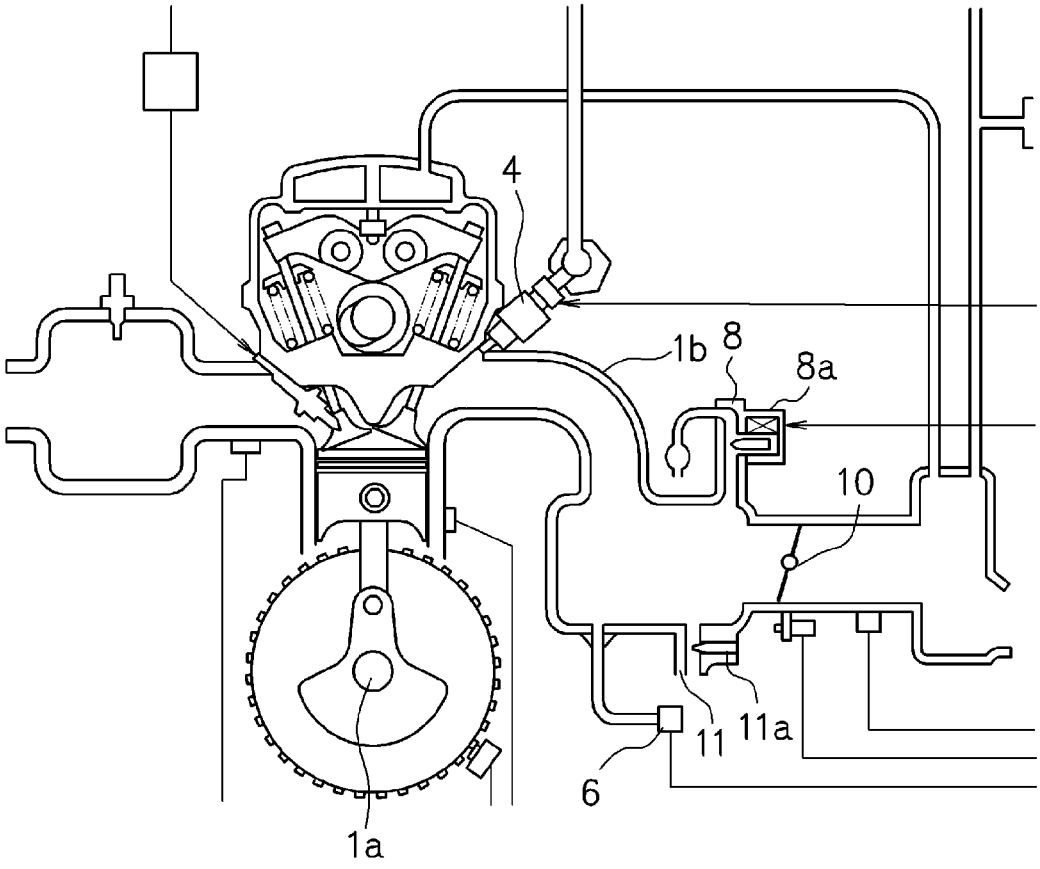
FIG. 2 is a drawing illustrating an intake structure of an engine.

FIG. 1 is a drawing illustrating a schematic configuration of an engine start control system of one embodiment. FIG. 2 is a drawing illustrating an intake structure of an engine 1. Note that FIG. 1 only illustrates constituents around the engine 1 and an ECM 9 necessary for applying the present invention, leaving the other constituents not illustrated.

Reference numeral 1 denotes an engine as an internal combustion engine.

Reference numeral 2 denotes a recoil starter which functions as a manual starter, configured to induce rotation of a crankshaft 1*a* (see FIG. 2) of the engine 1, by pulling by hand a rope 2*a* wound around a pulley. Reference numeral 3 denotes a generator which is driven by rotation of the crankshaft 1*a* of the engine 1.

Reference numeral 4 denotes an injector which functions as an electronic fuel injector, and is attached to an intake pipe 1*b* (see FIG. 2) of the engine 1. The injector 4 feeds a fuel, fed from an unillustrated fuel pump, by injecting it into the intake pipe 1*b*, according to a driving signal received from the ECM 9.

Reference numeral 5 denotes an engine speed sensor which detects engine speed based on time necessary to reach a predetermined crank angle.

Reference numeral 6 is a pressure sensor which functions as a pressure detection section, and detects pressure in the intake pipe 1*b* on the downstream side of a throttle valve 10 (see FIG. 2).

Reference numeral 7 denotes a throttle aperture sensor which functions as a throttle aperture detection section, and detects aperture of the throttle valve 10.

Reference numeral 8 denotes an idle speed control valve (referred to as "ISC valve", hereinafter) which functions as an air regulator, and feeds air into the intake pipe 1*b* on the downstream side of the throttle valve 10.

Reference numeral 9 denotes an ECM which functions as a engine control device, and is configured by a CPU, a RAM, a ROM and so forth which function as a maximum value detection unit 9*a*, an idling control unit 9*b*, a correction unit 9*c* and a storage unit 9*d*. The ECM 9 operates as powered by the generator 3.

In the maximum value detection unit 9*a*, a maximum value of pressure in the intake pipe 1*b* detected by the pressure sensor 6 (referred to as "basic atmospheric pressure", hereinafter) is detected, within a predetermined range of crank angle after the activation of the ECM 9, in the process of starting using the recoil starter 2.

The idling control unit 9*b* takes part in feedback control of the ISC valve 8, based on the engine speed detected by the engine speed sensor 5, to thereby keep the idling engine speed at a specified value.

The correction unit 9*c* corrects the basic atmospheric pressure based on control volume of the ISC valve 8 by the idling control unit 9*b*, which is a duty ratio of the ISC valve 8 in idling in this embodiment, to thereby adjust it to the atmospheric pressure.

The storage unit 9*d* stores a map in which the duty ratio of the ISC valve 8 in idling is correlated with the amount of correction to be made on the basic atmospheric pressure.

As illustrated in FIG. 2, the intake pipe 1*b* of the engine 1 is provided with the throttle valve 10. The aperture of the throttle valve 10 in the closed state corresponds to leakage from the fully-closed throttle valve 10.

There is also provided the ISC valve 8 which feeds air into the intake pipe 1*b* on the downstream side of the throttle valve 10. The idling control unit 9*b* of the ECM 9 determines a ratio of valve opening of the ISC valve 8 based on duty control of a solenoid (electromagnetic valve) 8*a*. For an exemplary case where an ON/OFF signal having a cycle time of 100 msec is repeated, and the ON duration accounts for 50 msec out of 100 msec, then the duty ratio will be 50%. The idling control unit 9*b* of the ECM 9 keeps the idling engine speed at a specified value, by increasing the duty ratio of the ISC valve (by increasing the aperture of the ISC valve 8) so as to increase the idling engine speed when the idling engine speed slows down, and conversely, by decreasing the duty ratio of the ISC valve 8 (by decreasing the aperture of the ISC valve 8) so as to decrease the idling engine speed when the idling engine speed increases.

There is also provided a bypass port 11 connected on the downstream side of the throttle valve 10. The bypass port 11 has an adjust screw 11*a* attached thereto, adjustment of which may change the aperture of the bypass port 11, and may change the volume of air flowing through the intake pipe 1*b*. Note that, in reality, the idling engine speed is not adjustable by the adjust screw 11*a*, since the amount of change in air volume made by the adjust screw 11*a* is cancelled by the ISC valve 8, and so that the idling engine speed will not deviate from the specified value. What is controlled by the adjust screw 11*a* is the aperture of the ISC valve 8, that is, the duty ratio of the ISC valve 8.

As described in the above, air is fed through the throttle valve 10, the ISC valve 8 and the bypass port 11, into a combustion chamber of the engine 1. Also the idling engine speed is determined by the aperture of the throttle valve 10 (leakage under full closure), the aperture of the ISC valve 8, and the aperture of the bypass port 11. The aperture (duty ratio) of the ISC valve 8 is controlled, so as to keep the idling engine speed constant.

Figure 3:
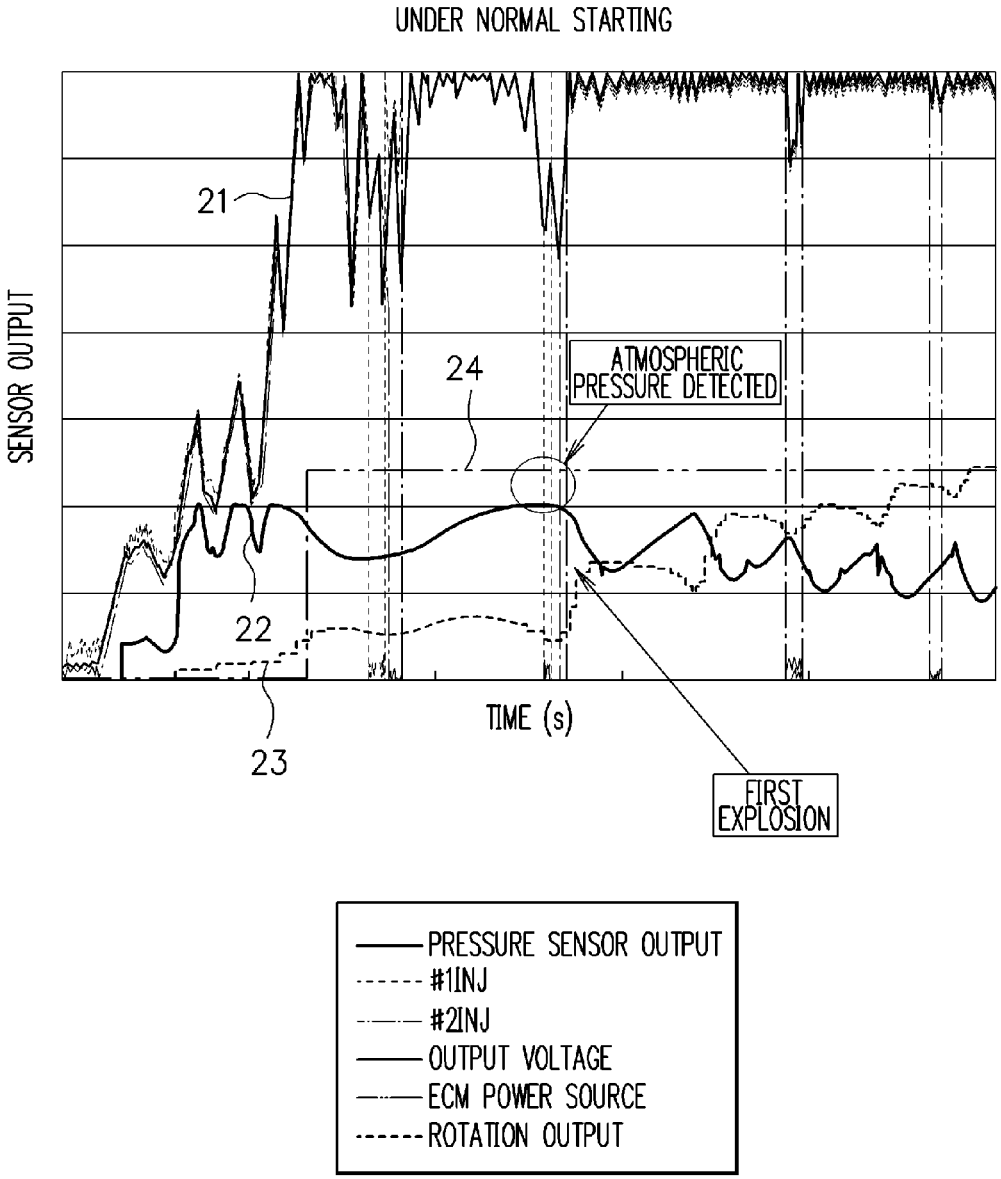
FIG. 3 is a drawing illustrating characteristics regarding voltage generated by a generator, pressure in an intake pipe, engine speed, and characteristics of an ECM power source, in the process of starting using a recoil starter.

Next, characteristics of voltage generated by the generator 3 in the process of starting using the recoil starter 2 (output voltage of the generator 3), pressure in the intake pipe 1*b* (output of the pressure sensor 6), engine speed (rotation output of the engine speed sensor 5), and an ECM power source are shown in FIG. 3.

As indicated by a characteristic curve 23 in FIG. 3, the engine speed appears as a result of manually cranking in the process of starting using the recoil starter 2. In association therewith, the generator 3 operates to elevate the voltage generation as indicated by a characteristic curve 21. When the voltage generation of the generator 3 exceeds a predetermined level, the ECM 9 activates as indicated by a characteristic curve 24. When combustion occurs thereafter as a result of ignition in a specified timing beyond the compression dead top center (first explosion), the engine 1 starts to thereby elevate the engine speed.

Now, in the manually cranking, that is, in a period before the engine starts to rotate under its own power, the pressure in the intake pipe 1*b* becomes negative relative to the atmospheric pressure in the intake process, as indicated by a characteristic curve 22, and peaks at the time of switching from the exhaust process to the intake process, showing the maximum value close to the atmospheric pressure. Note that the pressure in the intake pipe 1*b*, once the engine 1 began to rotate under its own power, becomes negative relative to the atmospheric pressure, also the maximum value thereof does not reach the atmospheric pressure, rather than coming into agreement with the atmospheric pressure.

As described in the above, in the manually cranking, while the maximum value of pressure in the intake pipe 1*b* (basic atmospheric pressure) is close to the atmospheric pressure, a shift from the atmospheric pressure actually occurs depending on the state of opening of the intake pipe 1*b* involved therein. The larger the state of opening of the intake pipe 1*b* during the manually cranking, the larger the volume of air fed thereto, and the closer the basic atmospheric pressure to the atmospheric pressure. Conversely, the closer the state of opening to the closed state, the smaller the volume of air fed thereto, and the more lower the basic atmospheric pressure than the atmospheric pressure. The difference in the state of opening of the intake pipe 1*b* in the manually cranking is typically ascribable to that there is some variation in the leakage under full closure of the throttle valve 10 among the engines 1, that the leakage under full closure may vary with time even in the same engine 1, and that the aperture of the bypass port 11 varies as a result of adjustment of the adjust screw 11*a*.

Figures 4, 5:
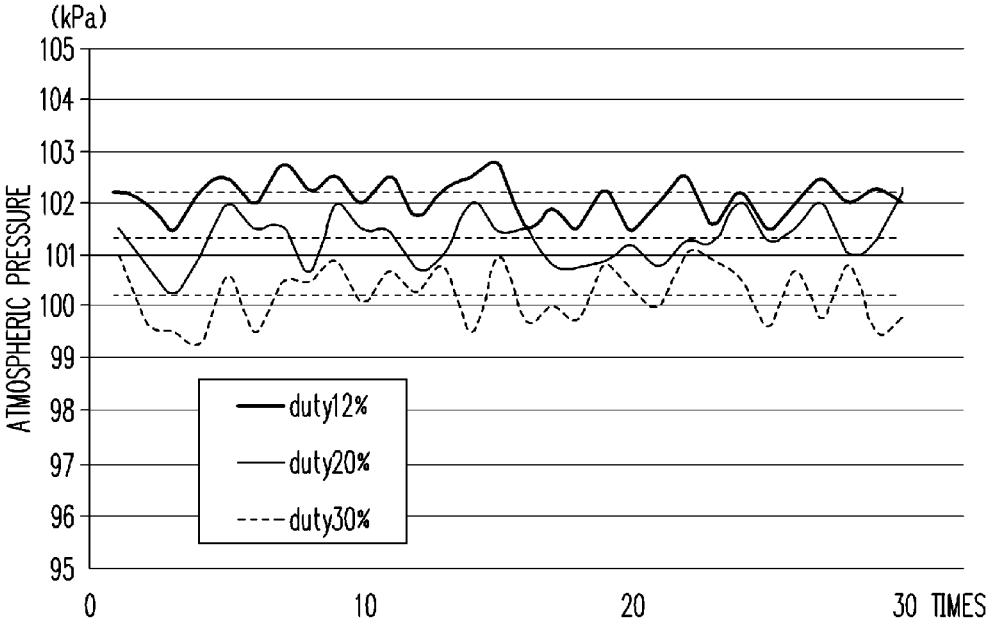
FIG. 4 is a characteristic drawing illustrating relations between the number of times of starting under various values of duty ratio of an ISC valve in idling, and maximum value of pressure in the intake pipe.
FIG. 5 is a drawing illustrating an exemplary map preliminarily correlating duty ratio of the ISC valve in idling with the amount of correction to be made on the basic atmospheric pressure.

As illustrated in FIG. 4, the present inventors confirmed the maximum value of the pressure in the intake pipe 1*b*, during the manually cranking (immediately after activation of the ECM 9). FIG. 4 is a characteristic drawing illustrating relations between the number of times of starting at various duty ratios of the ISC valve in idling, and maximum value of pressure in the intake pipe 1*b*.

In this experiment, the adjust screw 11*a* of the bypass port 11 was turned to adjust the duty ratio of the ISC valve 8 in idling to 30%, 20% and 12%. The smaller the aperture of the bypass port 11, the larger the duty ratio of the ISC valve 8 in idling, whereas the larger the aperture of the bypass port 11, the smaller the duty ratio of the ISC valve 8 in idling. Note that duty ratio of the ISC valve 8 necessary for keeping the idling engine speed at a specified value, with the bypass port 11 fully closed, is 34%.

The engine was started 30 times using the recoil starter 2 respectively for the individual apertures of the bypass ports 11, that is, while setting the duty ratio of the ISC valve 8 in idling to 30%, 20% or 12. The manually cranking was conducted while keeping the throttle almost closed, with the ISC valve 8 fully opened (duty ratio=100%). As a consequence, as illustrated in the drawing, average value of the basic atmospheric pressure was found to be higher in the case with a duty ratio of 20% than the case with a duty ratio of 30%, and was also found to be higher in the case with a duty ratio of 12% than the case with a duty ratio of 20%, yielding values more closer to the atmospheric pressure. It was also found that the smaller the duty ratio in idling, the smaller the variation in the basic atmospheric pressure. Assuming now, for compensating shortage of number of samples, that the measured values normally distribute with a variation of 3o, the variation was found to be 4.7% relative to the average value for a duty ratio of 30%, and was found to be 1.2% relative to the average value for a duty ratio of 12%. No difference was found in stability of idling, under different duty ratios of the ISC valve 8.

In the engine start control system applied by the present invention, the aperture of the throttle valve 10 and the aperture of the bypass port 11 in the process of starting using the recoil starter 2 is estimated from the duty ratio of the ISC valve 8 in idling, and based on which the basic atmospheric pressure is corrected to give the atmospheric pressure.

As described in the above, the idling engine speed is determined by the aperture of the throttle valve 10 (leakage under full closure), the aperture of the ISC valve 8, and the aperture of the bypass port 11, and the aperture (duty ratio) of the ISC valve 8 is controlled so as to keep the idling engine speed at a specified value. In other words, the larger the aperture (duty ratio) of the ISC valve 8 in idling, the relatively smaller the total of the aperture of the throttle valve 10 and the aperture of the bypass port 11 in idling. Conversely, the smaller the aperture (duty ratio) of the ISC valve 8 in idling, the relatively larger the total of the aperture of the throttle valve 10 and the aperture of the bypass port 11 in idling. The total of the aperture of the throttle valve 10 and the aperture of the bypass port 11 in idling is equal to that observed in the manually cranking with the throttle kept closed.

Now, as illustrated in FIG. 5, based on experimental values obtained from an engine of the same type and of same specifications, duty ratios X1, X2, . . . of the ISC valve 8 in idling and the amounts of correction a, b, . . . with respect to the basic atmospheric pressure are mapped, and stored in the storage unit 9*d*. More specifically, as illustrated in FIG. 4, the duty ratio of the ISC valve 8 in idling is adjusted to X1, X2, . . . and the basic atmospheric pressure is confirmed for each state. The manually cranking is conducted while keeping the throttle almost closed, and with the ISC valve 8 fully opened (duty ratio=100%). The amounts of correction a, b, . . . are determined so that values of the basic atmospheric pressure obtained for the individual duty ratios coincide with the atmospheric pressure. The amounts of correction a, b, . . . may be coefficients for multiplication, or may be additional values for compensating shortage below the atmospheric pressure.

As is understood from FIG. 4, the larger the duty ratio of the ISC valve 8 in idling, the relatively smaller the total of the aperture of the throttle valve 10 and the aperture of the bypass port 11 in idling. In other words, in the manually cranking conducted with the throttle kept closed, the state of opening of the intake pipe 1*b* is close to the fully closed state, and the basic atmospheric pressure tends to be lower than the atmospheric pressure. Accordingly, the amount of correction for more largely correcting the basic atmospheric pressure will be determined, under larger duty ratio of the ISC valve 8 in idling.

Figure 6:
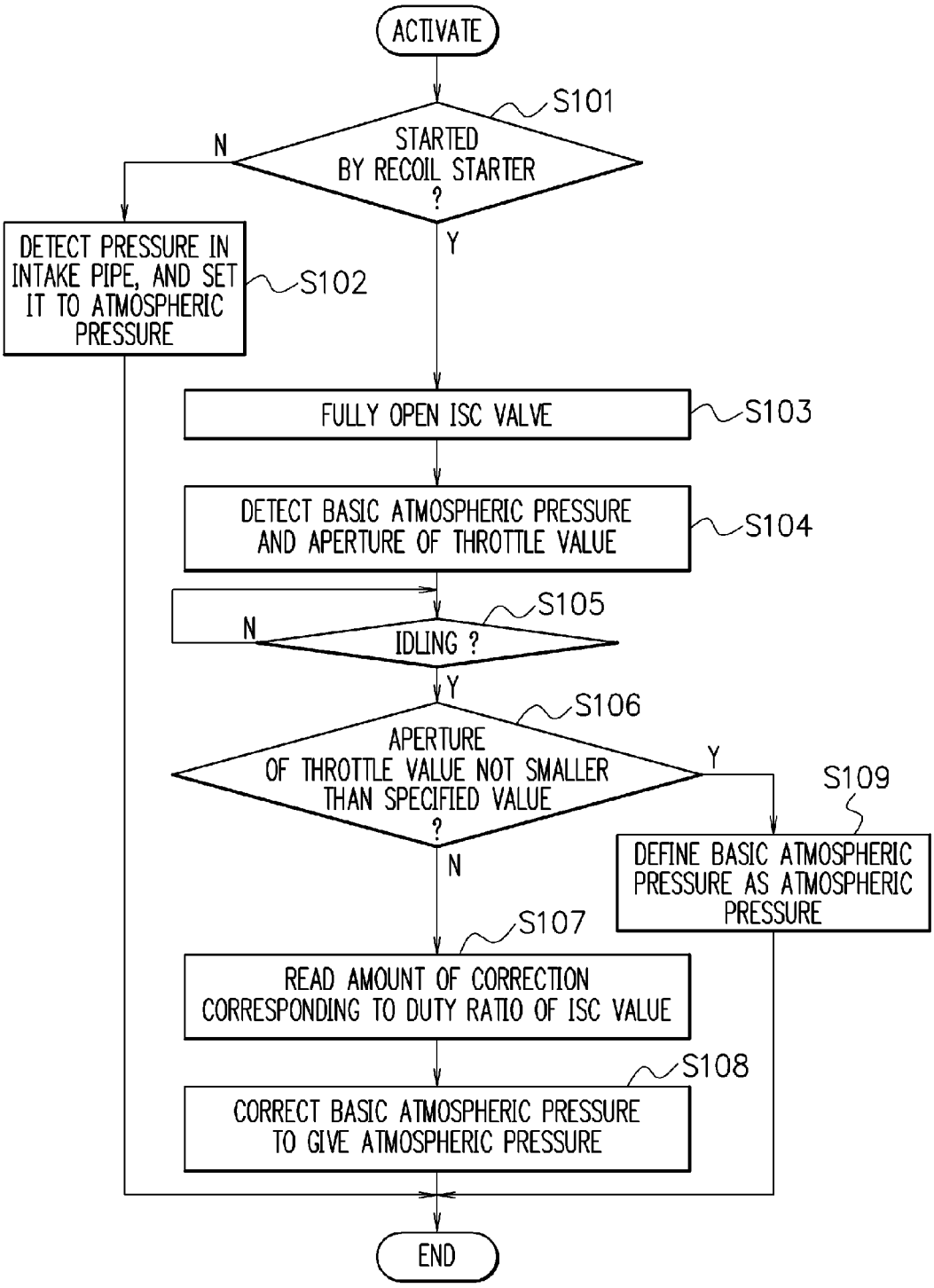
FIG. 6 is a flow chart illustrating processing action executed by the ECM of the embodiment.

FIG. 6 is a flow chart illustrating processing action executed by the ECM 9 of this embodiment. Note that the flow chart in FIG. 6 illustrates only a part of the processing action (processing action after activation), so that processing action under normal operation (for example, control of fuel injection by the injector 4) is not illustrated.

This embodiment will explain an exemplary case where an unillustrated additional battery and a starter motor are installed so as to enable both of starting with the aid of the starter motor and starting with the aid of the recoil starter 2.

The ECM 9, when activated upon being powered, determines by which of the starter motor or the recoil starter 2 it was activated (step S101). If the activation was made by the starter motor, the ECM 9 may be powered from a battery and may be activated, by pressing an unillustrated started switch. On the other hand, if the activation was made by the recoil starter 2, the ECM 9 may be powered from the generator 3 as a result of manually cranking, and may be activated. Accordingly, the ECM 9 may determine whether the activation was made by the starter motor or the recoil starter 2, by determining from which port the electric power was fed.

In the activation with the aid of the starter motor, since the ECM 9 activates immediately upon being powered from the battery, so that the pressure in the intake pipe 1*b* when the crankshaft 1*a* stays still is detectable by the pressure sensor 6. The pressure in the intake pipe 1*b* when the crankshaft 1*a* stays still is equal to the atmospheric pressure, so that the ECM 9 stores data of the pressure in the intake pipe 1*b* detected by the pressure sensor 6 in a memory, for later use as the atmospheric pressure (step S102), and uses it for controlling fuel injection by the injector 4.

In the activation with the aid of the recoil starter 2, the ECM 9 fully opens the ISC valve 8 (duty ratio=100%) (step S103). This is for the purpose of making the pressure in the intake pipe 1*b* closer as possible to the atmospheric pressure.

The maximum value detection unit 9*b* of the ECM 9 then detects the basic atmospheric pressure, that is, a maximum value (which may be a maximum value per se, or may be an average value over a peak area) of the pressure in the intake pipe 1*b* detected by the pressure sensor 6, within a predetermined range of crank angle after activation (step S104). For example, an EEPROM in the ECM 9 is rewritten with data of pressure in the intake pipe 1*b* detected for the first time by the pressure sensor 6. Thereafter, until a predetermined level of crank angle is reached, the EEPEOM is rewritten with data of pressure in the intake pipe 1*b* sequentially detected by the pressure sensor 6, only when the newly detected pressure is higher than the already stored pressure. For example, a moving average value of the pressure in the intake pipe 1*b* may be determined for every detection cycle, and the EEPROM may be rewritten only when a moving average value of the pressure in the intake pipe 1*b* in the latest detection cycle is higher than the moving average value already stored in the EEPROM. In this way, the EEPROM will have stored therein a maximum value of the pressure in the intake pipe 1*b* (basic atmospheric pressure), within a predetermined range of crank angle after the activation.

The ECM 9 also detects the aperture of the throttle valve 10 detected by the throttle aperture sensor 7, within a predetermined range of crank angle after the activation (step S104).

After the engine 1 began to rotate under its own power, the ECM 9 determines whether the engine 1 is in the idling state or not (step S105).

If the engine 1 was found to be in the idling state, whether the aperture of the throttle valve 10 detected in step S104, that is, the aperture of the throttle valve 10 in the process of manually cranking, is not smaller than the specified value is determined (step S106). While the manually cranking is generally conducted while keeping the throttle almost closed, some user may start the engine using the recoil starter 2, while keeping the throttle opened. Note that the decision may alternatively be made on whether the average aperture of the throttle valve 10 within a predetermined range of crank angle after the activation of the ECM 9 reaches the specified value or above, or may be made whether the aperture of the throttle valve 10 reaches the specified value or above even only once within a predetermined range of crank angle after the activation of the ECM 9.

If the aperture of the throttle valve 10 detected in step S104 is smaller than a specified value, the ECM 9 reads the amount of correction out from the map stored in the storage unit 9*d*, depending on the duty ratio of the ISC valve 8 determined by the idling control unit 9*b* (step S107). The basic atmospheric pressure detected in step S104 is then corrected using the amount of correction, and stored in a memory for later use as the atmospheric pressure (step S108), and used thereafter for controlling fuel injection by the injector 4.

On the contrary, if the aperture of the throttle valve 10 detected in step S104 is not smaller than a specified value, the intake pipe 1*b* in the process of manually cranking is in the opened state, and the pressure in the intake pipe 1*b* coincides with the atmospheric pressure. The basic atmospheric pressure detected in step S104 is then stored into the memory for later use as the atmospheric pressure in an intact form without correction (step S109), and used thereafter for controlling fuel injection by the injector 4.

Note that, for the case of starting with the aid of the recoil starter 2 in this embodiment, the ISC valve 8 during the manually cranking was kept fully opened (duty ratio=100%) (step S103). This is for the purpose of making the pressure in the intake pipe 1*b* closer as possible to the atmospheric pressure. It is, however, not always necessary to keep the ISC valve 8 fully opened (duty ratio=100%), and it suffices that the ISC valve 8 is set to a constant duty ratio during the manually cranking. In the process of preliminarily obtaining the duty ratios X1, X2, . . . of the ISC valve 8 in idling and the amounts of correction a, b, . . . with respect to the basic atmospheric pressure based on experimental values, the experiment is of course conducted while setting values of the duty ratio similar to those in step S103.

As described in the above, for the case where the pressure in the intake pipe 1*b* is detected in the process of manually cranking and is used as the atmospheric pressure, the present invention yields a more accurate atmospheric pressure, since the invention was configured to estimate the state of opening of the intake pipe 1*b* during the manually cranking based on the duty ratio of the ISC valve 8 in idling, and to correspondingly correct the maximum value of pressure in the intake pipe 1*b*.

Having described the present invention referring to various embodiments, the present invention is by no means limited to these embodiment, and may be modified within the scope of the present invention.

For example, in the embodiment described in the above, the correction for determining the atmospheric pressure is not available until the idling state is reached after the starting by the recoil starter 2. Accordingly, a possible alternative method may be such that the duty ratio of the ISC valve 8 in idling in the previous operation is stored, and if the basic atmospheric pressure is detected in step S104, the correction is made using the amount of correction corresponded to the duty ratio in the previous operation. Of course, there is no denying that the adjust screw 11*a* is adjusted between the previous operation and the present operation, but it is a rare case. An advantage of making the correction possible without waiting for the idling state surpasses.

According to the present invention, for the case where the pressure in the intake pipe is detected in the process of manually cranking and is used as the atmospheric pressure, a more exact atmospheric pressure may be obtained by correcting the pressure in the intake pipe.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An engine start control system comprising:

a manual starter inducing manual rotation of a crankshaft of an engine;

a generator driven by the rotation of the crankshaft associated with the manual starter:

an electronic fuel injector feeding a fuel to the engine according to a driving signal received from an engine control device:

an the engine control device activated by electric power generated by the generator;

a pressure detection section in the engine control device, detecting a maximum pressure in an intake pipe on the downstream side of a throttle valve of the engine;

a throttle aperture detection section detecting aperture of the throttle valve; and an air regulator feeding air to the intake pipe on the downstream side of the throttle valve, the engine control device comprising:

a maximum value detection section configured to detect, in the process of starting by the manual starter, a maximum value of pressure in the intake pipe detected by the pressure detection section, within a predetermined range of crank angle after activation of the engine control device, wherein the predetermined range is between after activation of the engine control device and until start of rotation of the engine under its own power:

an idling control section configured to control the air regulator to thereby keep an idling engine speed at a specified value; and a correction section configured to correct the maximum value of pressure in the intake pipe detected by the maximum value detection section to the atmospheric pressure, based on a control volume of the air regulator made by the idling control section, and not correcting the maximum value of pressure if the aperture of the throttle valve detected by the throttle aperture detection section is not smaller than the specified value, within a predetermined range of crank angle after activation of the engine control device.

2. The engine start control system according to claim 1, wherein the control volume of the air regulator by the idling control section is preliminarily correlated with the amount of correction made on the maximum value of pressure in the intake pipe, and the correction section performs the correction using the amount of correction.

* * * * *